US007498987B2

(12) United States Patent
Svigelj et al.

(10) Patent No.: US 7,498,987 B2
(45) Date of Patent: Mar. 3, 2009

(54) ELECTRICALLY SMALL LOW PROFILE SWITCHED MULTIBAND ANTENNA

(75) Inventors: John A. Svigelj, Crystal Lake, IL (US); Giorgi G. Bit-Babik, Sunrise, FL (US); Carlo Dinallo, Plantation, FL (US)

(73) Assignee: Motorola, Inc., Schaumburg, IL (US)

( * ) Notice: Subject to any disclaimer, the term of this patent is extended or adjusted under 35 U.S.C. 154(b) by 242 days.

(21) Appl. No.: 11/313,087

(22) Filed: Dec. 20, 2005

(65) Prior Publication Data

US 2007/0139276 A1 Jun. 21, 2007

(51) Int. Cl.
*H01Q 1/38* (2006.01)

(52) U.S. Cl. ..... 343/700 MS; 343/702; 343/829; 343/846

(58) Field of Classification Search ..... 343/700 MS, 343/702, 729, 770–771, 725, 846, 848, 676, 343/829

See application file for complete search history.

(56) References Cited

U.S. PATENT DOCUMENTS 6,133,883 A * 10/2000 Munson et al. ..... 343/700 MS
6,414,642 B2 * 7/2002 Honda et al. ..... 343/702
6,469,673 B2 * 10/2002 Kaiponen ..... 343/703
6,489,586 B1 12/2002 Corral
6,498,586 B2 * 12/2002 Pankinaho ..... 343/700 MS
6,646,618 B2 * 11/2003 Sievenpiper ..... 343/770
6,911,940 B2 * 6/2005 Poilasne et al. ..... 343/700 MS
6,985,108 B2 * 1/2006 Mikkola et al. ..... 343/700 MS
7,242,352 B2 * 7/2007 Tavassoli Hozouri . 343/700 MS
7,250,913 B2 * 7/2007 Chang et al. ..... 343/702

OTHER PUBLICATIONS

PCT Search Report Dated Jul. 30, 2008.

* cited by examiner

*Primary Examiner*—Douglas W. Owens
*Assistant Examiner*—Chuc Tran
(74) *Attorney, Agent, or Firm*—James A. Lamb; Valerie M. Davis

(57) ABSTRACT

A small volume antenna (100) has the form of a polygonal (e.g., square) board with multiple antenna elements (104, 110) located at vertices (114, 116) (e.g., opposite vertices). The antenna elements (104, 110) include two segments (118, 120, 124, 126) that meet at corners (122, 128) that are located at the vertices (114, 116). Peripheral portions (134, 136, 138, 140) of a ground plane (132) that underlie the segments (118, 120, 124, 126) of the antenna elements are deleted, and slots (154, 162) that have two joined segments (156, 158, 164, 166) that parallel the segments (118, 120, 124, 126) of the antenna elements (104, 110) are formed in the antenna elements. The antenna elements (104, 110) are selectively loaded by switched impedance (e.g., capacitance) networks (172, 176, 178, 180, 182, 186, 190, 192). The antenna (100) is able to support operation in at least two broad operating bands.

18 Claims, 7 Drawing Sheets

ELECTRICALLY SMALL LOW PROFILE SWITCHED MULTIBAND ANTENNA

RELATED ART

This application is related to U.S. patent application Ser. No. 10/945,234, filed on Sep. 20, 2004, entitled "Multi-Frequency Conductive Strip Antenna System", assigned to the assignee hereof.

FIELD OF THE INVENTION

The present invention relates generally to wireless communication devices. More particularly the present invention relates to antennas for wireless communication devices.

BACKGROUND

The deployment of cellular networks, satellite networks and other wireless networks, has greatly expanded the use of mobile wireless communication devices. Whether a wireless communication device is a handheld device or a vehicle mounted device, there is an abiding interest in making the devices small so that they can be conveniently carried or accommodated in a small allocated space.

Advances, by many orders of magnitude, in the degree of integration and miniaturization of electronics over the past few decades have facilitated extreme miniaturization of transceiver electronic circuits. However, the methods and means used to miniaturize electronic circuits, cannot be applied to miniaturize antennas, because antennas operate under the principles of Maxwell's equations, which, roughly speaking, indicate that if antenna efficiency is to be preserved, the size of the antenna must be scaled according to the wavelength of the carrier frequency of the wireless signals that are to be received and/or transmitted.

Compounding the challenge of reducing antennas size, is the fact, that for many wireless communication devices, the antenna system needs to support operation at multiple frequencies, e.g., in multiple relatively wide frequency bands. The obvious expedient of using separate antennas to support separate operating frequencies, is contrary to the desire to reducing the space occupied by the antenna system.

BRIEF DESCRIPTION OF THE FIGURES

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

Figure 1:
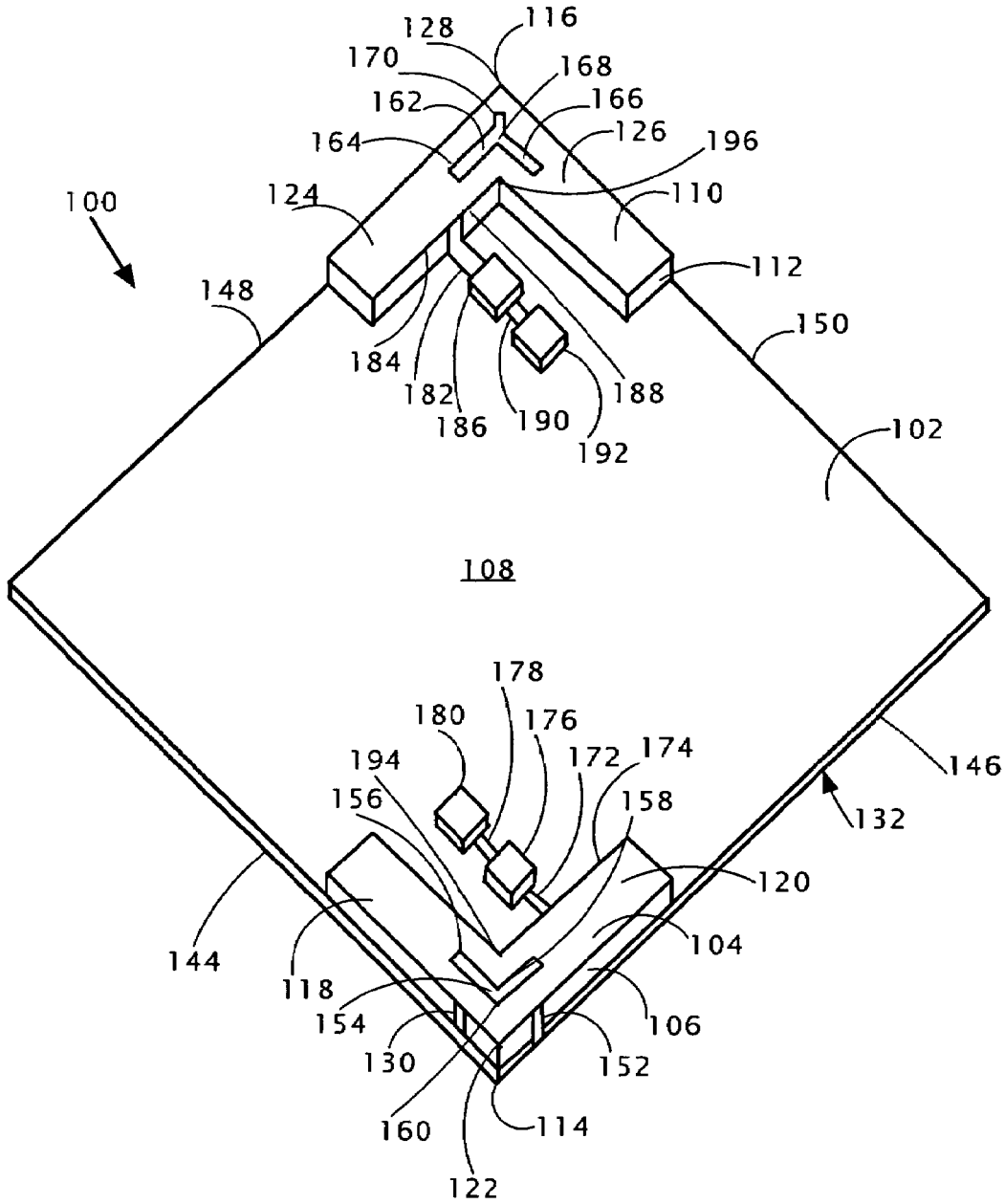
FIG. 1 is a top view of an antenna according to an embodiment of the invention.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION

Before describing in detail embodiments that are in accordance with the present invention, it should be observed that the embodiments reside primarily in combinations of apparatus components related to antennas. Accordingly, the apparatus components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element.

It will be appreciated that embodiments of the invention described herein may comprise one or more conventional processors and unique stored program instructions that control the one or more processors to implement, in conjunction with certain non-processor circuits, some, most, or all of the functions of communication described herein. The non-processor circuits may include, but are not limited to, a radio receiver, a radio transmitter, signal drivers, clock circuits, power source circuits, and user input devices. As such, these functions may be interpreted as steps of a method to perform communication. Alternatively, some or all functions could be implemented by a state machine that has no stored program instructions, or in one or more application specific integrated circuits (ASICs), in which each function or some combinations of certain of the functions are implemented as custom logic. Of course, a combination of the two approaches could be used. Thus, methods and means for these functions have been described herein. Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation.

Figure 2:
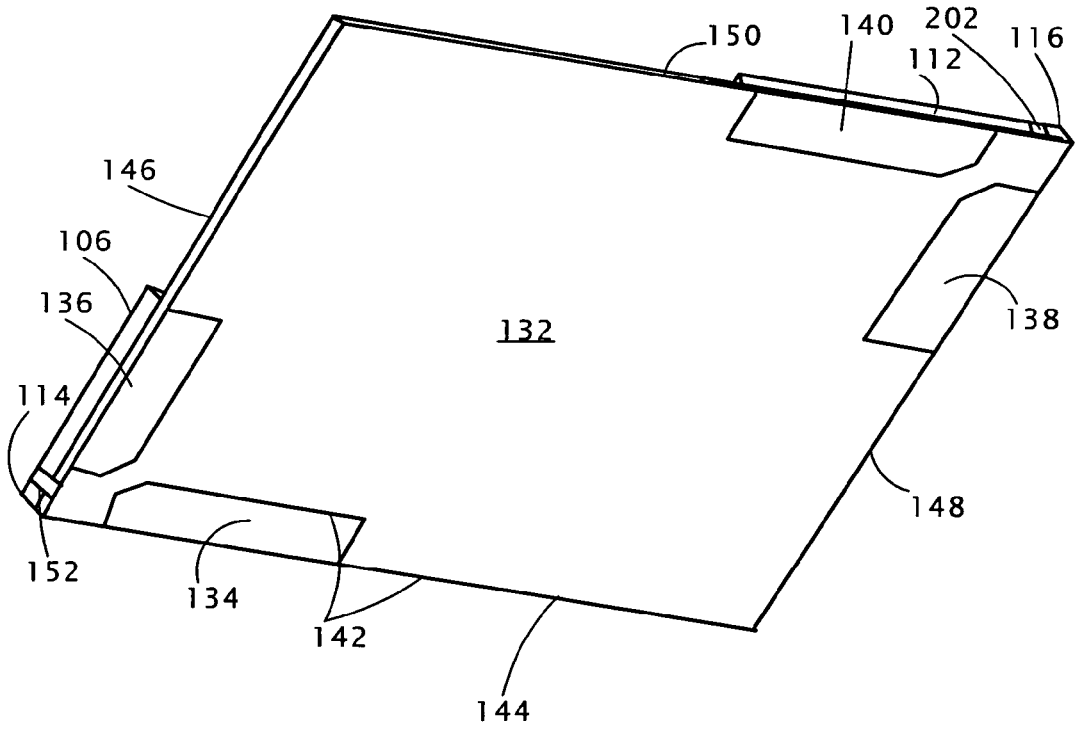
FIG. 2 is a bottom view of the antenna shown in FIG. 1 according to an embodiment of the invention.

FIG. 1 is a top view of an antenna 100 according to an embodiment of the invention and FIG. 2 is a bottom view of the antenna 100 shown in FIG. 1. The antenna 100 is built on square dielectric substrate 102. The dielectric substrate 102 is suitably made out of Duroid, FR-4 or other suitable materials. A first driven antenna element 104 is supported by a first dielectric spacer 106 on a top surface 108 of the dielectric substrate 102. Similarly a second driven antenna element 110 is supported by a second dielectric spacer 112 above the dielectric substrate 102. The first dielectric spacer 106 and the second dielectric spacer 112 are suitably made out of polytetrafluoroethylene, or other low loss tangent material. The first antenna element 104 and the second antenna element 110 are suitably made out of a highly conductive material such as copper or silver. The first antenna element 104 and the second antenna element 110 can be formed by metal working (e.g., stamping, machining), lift-off deposition, printing, lithography, electroless deposition or other suitable processes. The first antenna element 104 is located at a first vertex 114 of the square dielectric substrate 102 and the second antenna element 110 is located at a second (opposite) vertex 116 of the square dielectric substrate 102. In as much as a square is a convex polygon, positioning the first antenna element 104 and the second antenna element 110 at vertices, increases the utilizable electrical length of the antenna 100, for modes that involve strong current components directed radially from the antenna elements 104, 110 (e.g., along the diagonal of the square), thereby allowing the antenna 100 to be smaller for a given operating frequency. The design of the antenna 100, which is further described below, is such that the volume of the antenna 100, judged in view of the operating wavelengths of the antenna, is relatively small. For example, an embodiment of the antenna capable of supporting efficient operation in two frequency bands centered at 253 MHz and 303 MHz corresponding to free-space wavelengths of 1.18 meters and 0.99 meters has plan view dimensions of 30 centimeters by 30 centimeters and a height of 0.5 centimeters.

The first antenna element 104 comprises a first linear segment 118 and a second linear segment 120 that join contiguously at a right angle forming a first corner 122. The first corner 122 is located at the first vertex 114 of the antenna 100. Similarly, the second antenna element 110 comprises a third linear segment 124 and a fourth linear segment 126 that join contiguously at a right angle forming a second corner 128. The second corner 128 of the second antenna element 110 is located at the second vertex 116 of the antenna 100.

A first signal feed conductor 130 extends from the top surface 108 of the dielectric substrate 102 proximate the first corner 122 to the first linear segment 118.

The antenna 100 further comprises a ground plane 132 disposed on the dielectric substrate 102 opposite the dielectric spacers 106, 112 and the antenna elements 104, 110. Alternatively, the ground plane 132 is located on the top surface 108 of the dielectric substrate 102 as the aforementioned components, or within a multilayered substrate that is used in lieu of the dielectric substrate 102. Such a multilayered substrate can take the form of a multilayer circuit board that has one or more ground planes.

As shown in FIG. 2 the ground plane 132 has four deleted areas 134, 136, 138, 140, including a first deleted area 134 and a second deleted area 136 that are disposed under the first segment 118 and the second segment 120 of the first antenna element 104 respectively. Similarly a third deleted area 138 and a fourth deleted area 140 are located under the third segment 124 and the fourth segment 126 of the second antenna element 110 respectively. Accordingly, a perimeter 142 of the ground plane 132 is reentrant (with respect to an otherwise square shape) at the deleted areas 134, 136, 138, 140. The ground plane 132 can be patterned using various methods such as the methods mentioned above in reference to the antenna elements 104, 110.

The first linear segment 118 and the second linear segment 120 extend parallel to a first edge 144 and a second edge 146 of the antenna 100 that join at the first vertex 114. Similarly the third segment 124 and the fourth segment 126 extend parallel to a third edge 148 and a fourth edge 150 of the antenna 100 that join at the second vertex 116. The antenna elements 104, 110 are shaped to guide currents along the edges 144, 146, 148, 150, thereby bringing the currents over the deleted areas 134, 136, 138, 140. Although not wishing to be bound to any particular theory of operation, it is believed that the deleted areas 134, 136, 138, 140 create a field configuration that increases the radiative efficiency of the antenna 100, lowering the Q of the antenna, and thereby increasing the bandwidths of the antenna 100 for modes associated with two antenna elements 104, 110. Furthermore, it is believed that having the segments 118, 120, 124, 126 of the antenna elements 104, 110 run along the edges 144, 146, 148, 150 of the antenna 100 enhances the radiation associated with the deleted areas by inducing strong currents, charge densities and fields on the perimeter 142, where the fields more readily couple to free space (compared to a case where the deleted area is interior to the ground plane 132. Although the two antenna elements 104, 110 share the ground plane 132, the two elements 104, 110 are able to support operation in two different frequency bands without substantial mutual interference.

A first ground conductor 152 extends from the second linear segment 120 of the first antenna element 104 to the ground plane 132 proximate the first corner 122. A second ground conductor 202 extends from the third linear segment 124 of the second antenna element 110 to the ground plane 132 proximate the second corner 128. A second signal feed conductor (not shown) extends from the top surface 108 of the dielectric substrate 102 to the fourth linear segment 126 of the second driven antenna element 110. Signal lines (not shown) that are suitably formed on the top surface 108 of the dielectric substrate 102 connect the antenna elements 104, 110 to transceiver circuits (not shown). Alternatively, the antenna elements 104, 110 are coupled to transceiver circuits located on a separate circuit board.

The proximity of the signal feed conductors 130, and the ground conductors 152, 202 to the corners 122, 128 of the antenna elements 104, 110 effects input impedances of the antenna 100. A particular spacing which can be found by experimentation yields a particular desired real impedance e.g., 50 Ohms. The spacing that gives a desired real impedance is also dependent on the spacing of the antenna elements 104, 110 from the ground plane 132. As the spacing of the antenna elements 104, 110 from the ground plane increases the input impedance will increase. By way of example for an embodiment of the antenna 100 designed for operation at 300 MHz, that has an overall edge dimension of 30 cm, in which the lengths of the linear segments 118, 120, 124, 126 were about 130 millimeter and the antenna elements 104, 110 spaced from the ground plane 132 by 5 mm, the ground conductors 152, 202 and the signal feed conductors 130 are suitably spaced from the corners 122, 128 by about 4 mm.

A right angle shaped slot 154 is formed in the first antenna element 104. The right angle shaped slot 154 includes a fifth linear segment 156 and a sixth linear segment 158 that join at a third corner 160, that is located proximate the first corner 122 of the first antenna element 104. The fifth linear 156 segment is arranged parallel to the first linear segment 118, and the sixth linear segment is arranged parallel to the second linear segment 120.

A three legged slot 162 is formed in the second antenna element 110. The three legged slot 162 includes a seventh linear segment 164 arranged parallel to the third linear segment 124 of the second antenna element 110, an eighth linear segment 166, that extends parallel to the fourth linear segment 126 of the second antenna element 110 and intersects the seventh linear segment 164 at an intersection 168, that is located proximate the second corner 128 of the second antenna element 110. The three legged slot 162 also includes a ninth linear segment 170 that extends from the intersection 168 toward the second corner 128 of the second antenna element 110. Although linear segments are discussed above alternatively curved or curvilinear segments are used.

The right angle slot 154 and the three legged slot 162 are used to control the operating frequencies of the first and second antennas, respectively. In general, increasing the length of the slot legs will reduce the operating frequency of the antenna element.

A first microstrip 172 connects an inside edge 174 of the second segment 120 of the first antenna element 104 to a first switch 176. The first microstrip 172 runs up an inward facing side wall (not visible) of the first dielectric spacer 106. A second microstrip 178 connects the first switch 176 to a first capacitor 180. Thus, the first switch 176 selectively couples the first antenna element to the first capacitor 180. Similarly, a third microstrip 182 connects an inside edge 184 of the third segment 124 of the second antenna element 110 to a second switch 186. The third microstrip 182 runs up an inward facing side wall 188 of the second dielectric spacer 112. A fourth microstrip 190 connects the second switch 186 to a second capacitor 192. The first capacitor 180 and the second capacitor 192 are suitably grounded to the ground plane 132 through vias (not shown) that pass through the dielectric substrate 102. By selectively coupling the capacitors 180, 192 to the antenna elements 104, 110 the frequency bands of the antenna 100 can be shifted, effectively broadening the bandwidth of the antenna 100. This broadening effect compounds the bandwidth broadening provided by the deleted areas 134, 136, 138, 140 of the ground plane 132 and the bandwidth broadening provided by the slots 154, 162. The first switch 176 and the second switch 186 can be Micro-Electro Mechanical (MEMS) switches, or a solid state switch.

The exact positions on the inside edges 174, 184 of the antenna elements at which the antenna elements 104, 110 are capacitively loaded (i.e., the points at which the first microstrip 172 and the third microstrip 182 connect) are suitably close to an inside corner 194 of the first antenna element 104, and an inside corner 196 of the second antenna element 196 respectively. If it is only necessary to obtain a limited tuning range, the loading point could be connected at the inside corners 194, 196, but to obtain an increased tuning effect the point of connection is located away from the corner 310. On the other hand, moving the loading points too far away from the inside corners 194, 196 (e.g., beyond the longitudinal midpoints of the linear segments 118, 120, 124, 126) leads to degraded antenna performance.

Figure 3:
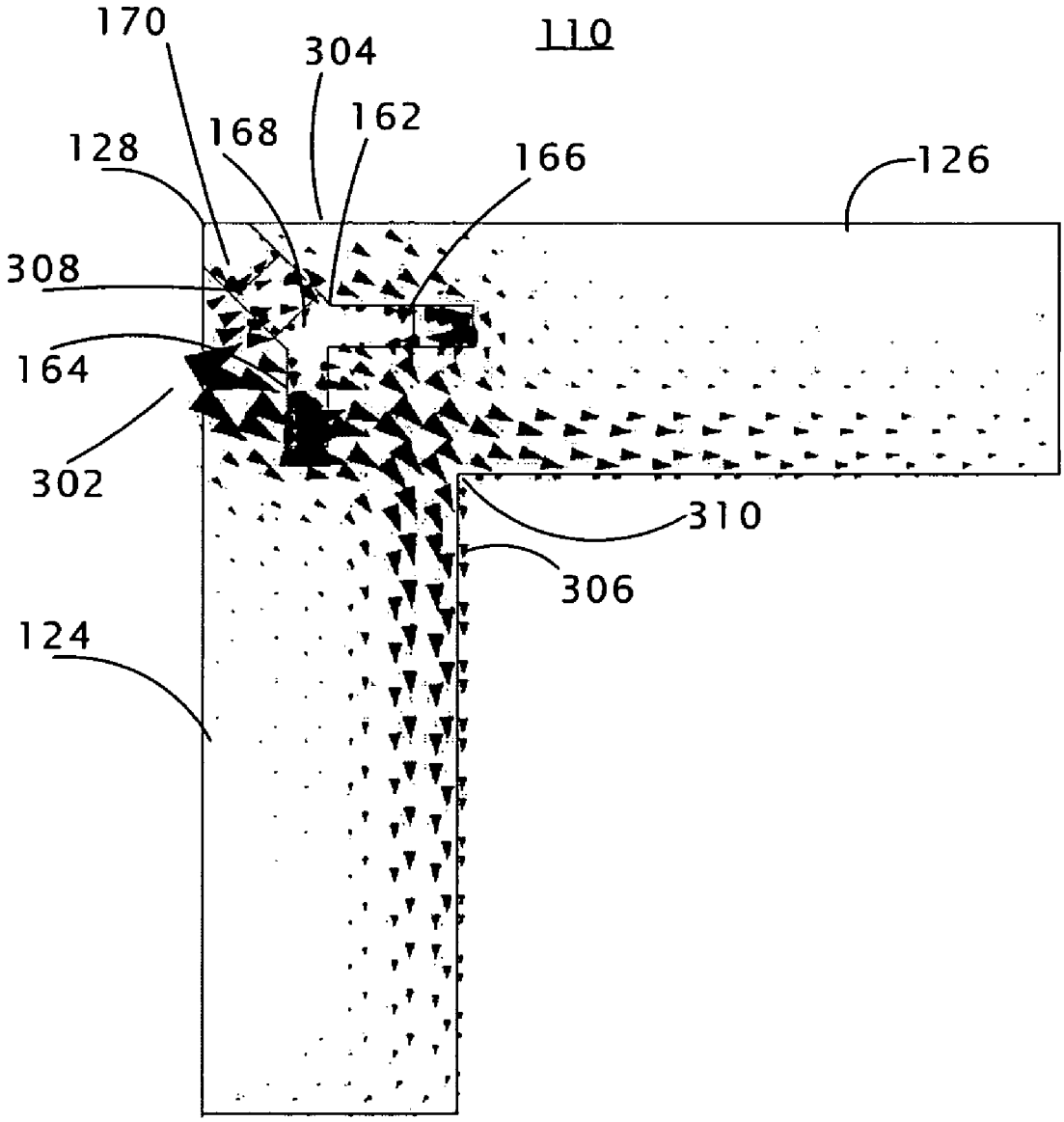
FIG. 3 is a plan view of a plan view of an antenna element of the antenna shown in FIGS. 1 and 2 with a superposed current distribution.

FIG. 3 is a plan view of a plan view of the second antenna element 110 of the antenna 100 shown in FIGS. 1 and 2 with a superposed current distribution. The position of the second feed conductor is indicated by reference numeral 302 and the position of the second ground conductor 202 is indicated by reference numeral 304. The position at which the second antenna element 110 is loaded (connected to the third microstrip 182) is indicated by reference numeral 306. In the modeled prototype on which FIG. 3 is based, the ninth linear segment 170 of the three legged slot 162 is bridged by a conductive bridge 308. The bridge 308 is used for tuning the input impedance. As shown in FIG. 3 the current pattern that is established when operation the antenna 100 includes a current flow that flows partly around the three legged slot 162, before diverging onto the third linear segment 124 and fourth linear segment 126. Note, also that the current is concentrated in areas overlying the ground plane. Consequently, the deleted areas of the ground plane serve to concentrate the current toward the inside of the antenna element 110. An effect of having both the slot 162 and the deleted areas 138, 140 is force a create a convoluted current path. Although not wishing to be bound to any particular theory of operation, it is believed that this convoluted current path serves to increase the effective electrical size of the antenna 100, allowing the antenna have a relatively reduced size for a given frequency of operation.

Figure 4:
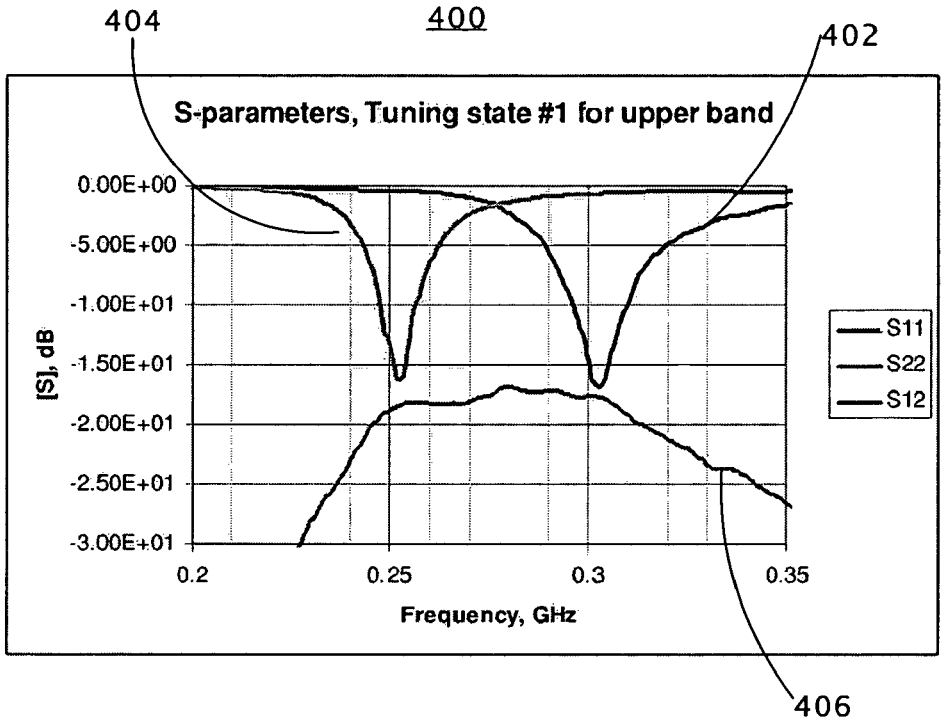
FIG. 4 is a first graph including S-parameter plots for a prototype of the antenna shown in FIG. 1 in a first tuning state.
Figure 5:
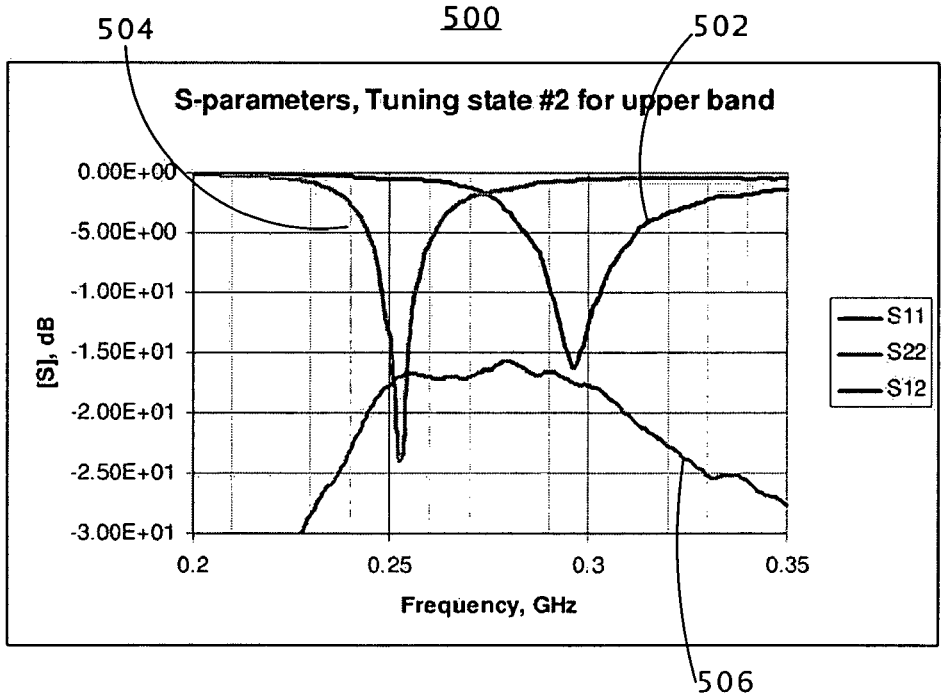
FIG. 5 is a second graph including S-parameter plots for the prototype of the antenna shown in FIG. 1 in a second tuning state.

FIG. 4 is a first graph 400 including S-parameter plots 402, 404, 406 for a prototype of the antenna shown in FIG. 1 in a first tuning state and FIG. 5 is a second graph 500 including S-parameter plots 502, 504, 506 for the prototype of the antenna shown in FIG. 1 in a second tuning state. In the prototype tested to obtain the data shown in FIGS. 4 and 5, the antenna elements were designed to provide two separate operating bands including a lower band centered at about 253 MHz and an upper band centered at about 303 MHz. Each antenna element plays a primary role in supporting one of the operating bands. The first graph 400 shows the S-parameters with no capacitive loading on either antenna element 104, 110 but the second graph 500 shows the S parameters with the antenna element associated with the upper band loaded with a capacitor (e.g., 180, 192). In the first graph 400, a first plot 402 (correspond to port 1) shows the return loss for the upper band and a second plot 404 (corresponding to port 2) shows the return loss for the lower band. Correspondingly, in the second graph 500, a third plot 502 (corresponding to port 1) shows the return loss for the upper band and a fourth plot 504 (corresponding to port 2) shows the return loss for the lower band. Comparing the two graphs 400, 500 it is seen that switching in the capacitive loading on the antenna element associated with the upper band, causes the upper band to shift down in frequency by about 6 MHz, thereby effectively increasing the obtainable bandwidth. Note that the lower band is also somewhat sharpened by capacitively loading the antenna element associated with the upper band, however the change in efficiency in the lower band is relatively small. (Note that a port is an abstraction that is physically embodied by the combination of a signal feed conductor, e.g., 130 and ground conductor e.g., 152)

A fifth plot 406 in the first graph 400 and a sixth plot 506 in the second graph shows the coupling between the ports feeding the two antenna elements 104, 110. Note that the coupling is limited to about 16dB, which corresponds to a high degree of isolation. Thus, the two antenna elements 104, 110 are able to achieve operation in two bands while sharing the common ground plane without suffering from excessive mutual interference.

Frequency tuning can be achieved by varying the lengths of the segments 118, 120, 124, 126 of the antenna elements 104, 110 and by varying the lengths of the slot segments 156, 158, 164, 166 that run parallel to the segments 118, 120, 124, 126 of the antenna elements.

Figure 6:
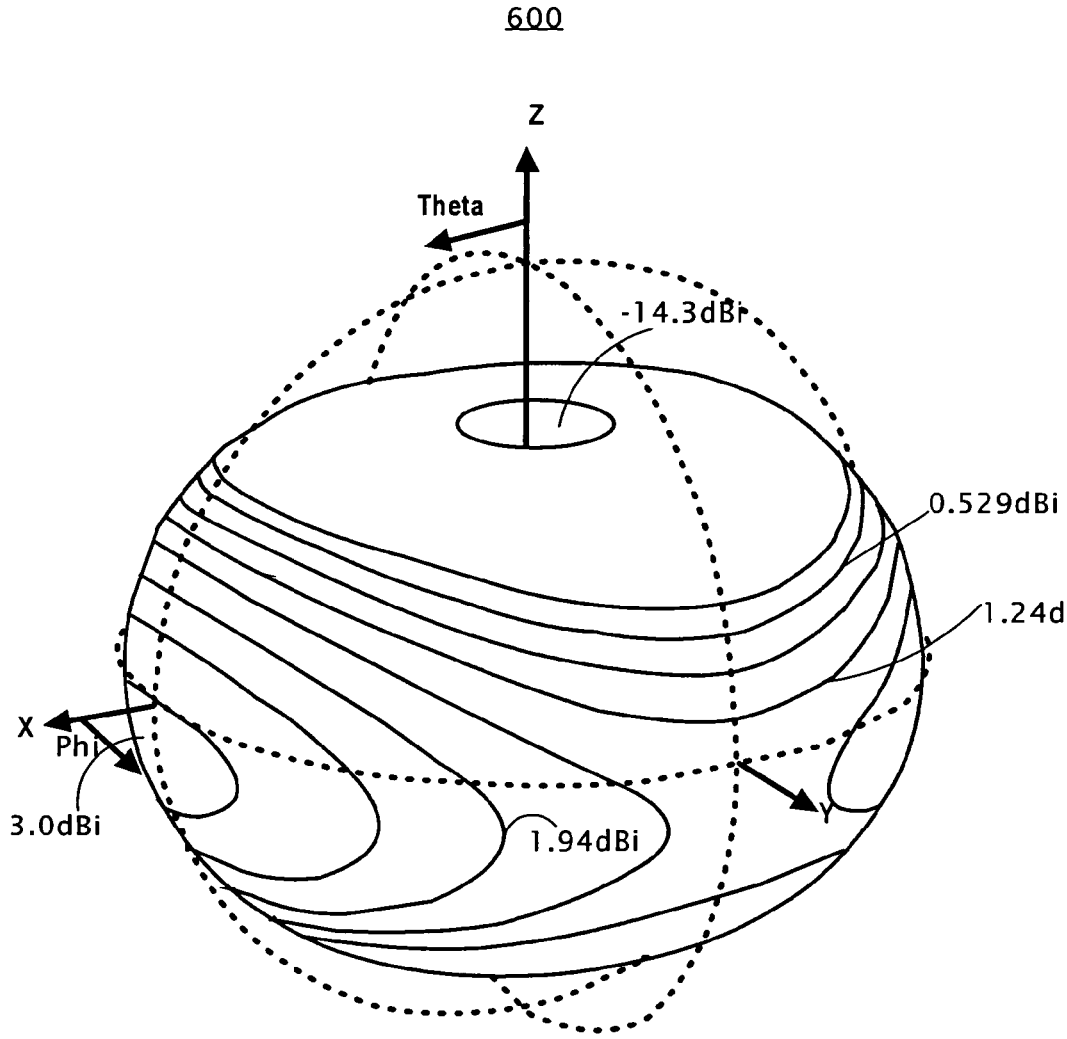
FIG. 6 is a three-dimensional radiation pattern plot for the antenna shown in FIG. 1.

FIG. 6 is a three dimensional radiation pattern plot 600 for the antenna shown in FIG. 1. The plot 600 shows a series of level curves on a sphere to indicate the gain in each direction.

In the plot Cartesian X, Y and Z axes are indicated. The Z-axis is aligned so as to pass through the first vertex 114 and the second vertex 116 of the antenna and the X-axis is aligned normal to the dielectric substrate 102.

Figure 7:
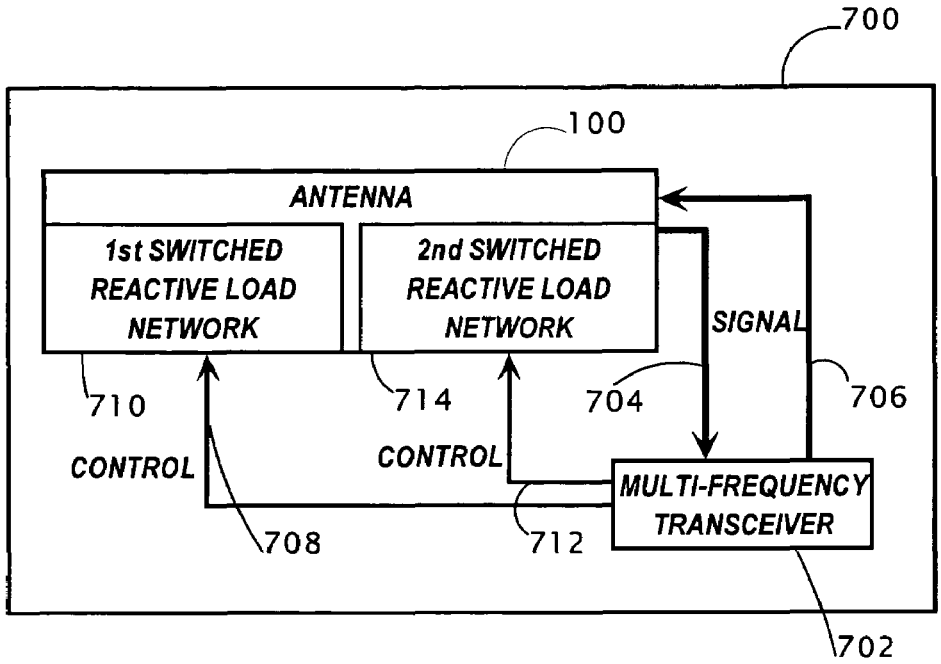
FIG. 7 is a block diagram of a radio using the antenna shown in FIG. 1 according to an embodiment of the invention.

FIG. 7 is a block diagram of a radio 700 using the antenna 100 shown in FIG. 1 according to an embodiment of the invention. The radio 700 includes a transceiver 702 that is coupled to the antenna 100 by a receive signal line 704 and a transmit signal line 706. The receive signal line 704 is suitably coupled to one of the antenna elements 104, 110 and the transmit signal line is suitably couple to another of the antenna elements 104, 110. Alternatively, both antenna elements 104, 110 are coupled to both receive signal lines and transmit signal lines. A first control line 708 is coupled to a first switched reactive load network 710 (e.g., made up of first microstrip 172, first switch 176, second microstrip 178 and first capacitor 180). Similarly, a second control line 712 is coupled to second switched reactive load network 714 (e.g., made up of third microstrip 182, second switch 186, fourth microstrip 190 and second capacitor 192). The control lines 708, 712 are used to apply signals to control the switches (e.g., 176, 186), in order to shift the operating bands of the antenna 100, in coordination with shifting of the frequency of signals transmitted from or received by the transceiver 702. The transceiver suitably comprises a Frequency Division Multi-Access (FDMA) transceiver, or a Frequency Hopping Spread Spectrum (FHSS) transceiver, or another type of transceiver that works with signals that change frequency.

Figure 8:
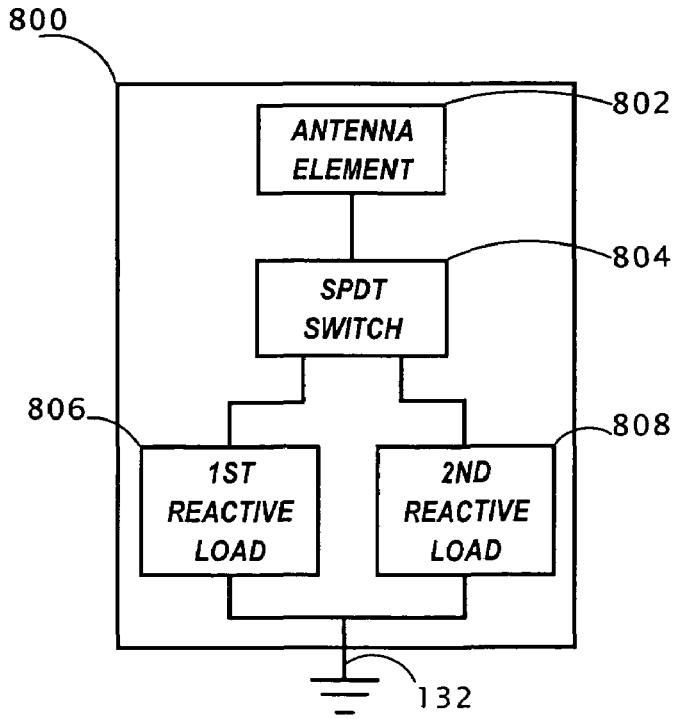
FIG. 8 is a schematic of an antenna according to another embodiment of the invention.

FIG. 8 is a schematic of an antenna 800 according to another embodiment of the invention. The antenna 800 includes an antenna element 802 (such as 104, 110) coupled to a common terminal of a first single pole double throw (SPDT) switch 804. A MEMS SPDT switch is suitably used. A first throw of the switch 804 is coupled to a first reactive load 806 and a second throw of the switch 804 is coupled to a second reactive load 808. Alternatively, one of the throw connections is left open. Thus, as in the case of the antenna 100 shown in FIGS. 1 and 2, in the antenna 800 two loading conditions can be obtained in the antenna 800, so that an operating band of the antenna 800 can be shifted.

Figure 9:
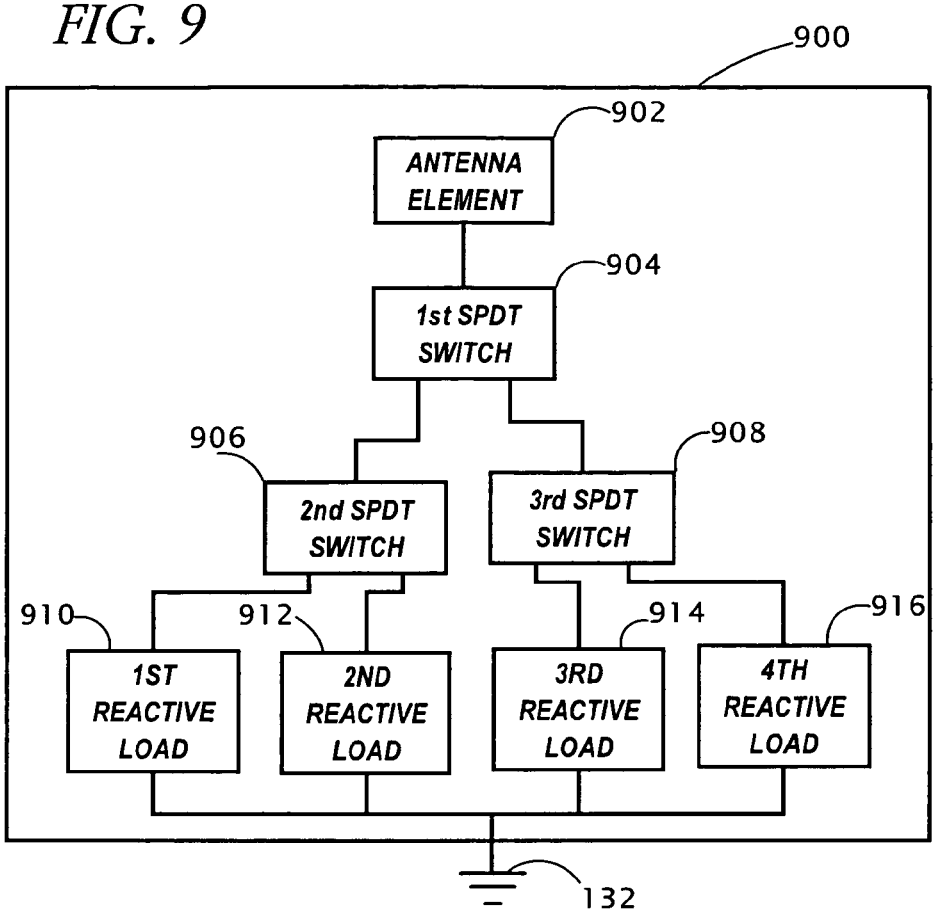
FIG. 9; is a schematic diagram of an antenna according to yet another embodiment of the invention.

FIG. 9 is a schematic diagram of an antenna 900 according to yet another embodiment of the invention. The antenna 900 includes an antenna element 902 (such as 104,110) coupled to a first SPDT switch 904. A first throw of the first SPDT switch 904 is coupled to a second SPDT switch 906 and a second throw of the first SPDT switch 904 is coupled to third SPDT switch 908. The second SPDT switch 906 is coupled to a first reactive load 910 and a second reactive load 912, and the third SPDT switch 908 is coupled to a third reactive load 914 and a fourth reactive load 916. Thus, by setting the states of the SPDT switches 904, 906, 908 the antenna 900 can be selectively coupled to one of the four reactive loads 910, 912, 914, 916. If the first SPDT switch 904 is a Single Pole Centre Off (SPCO) device, then the antenna element 902 can be decoupled from all of the reactive loads 910, 912, 914, 916.

Figure 10:
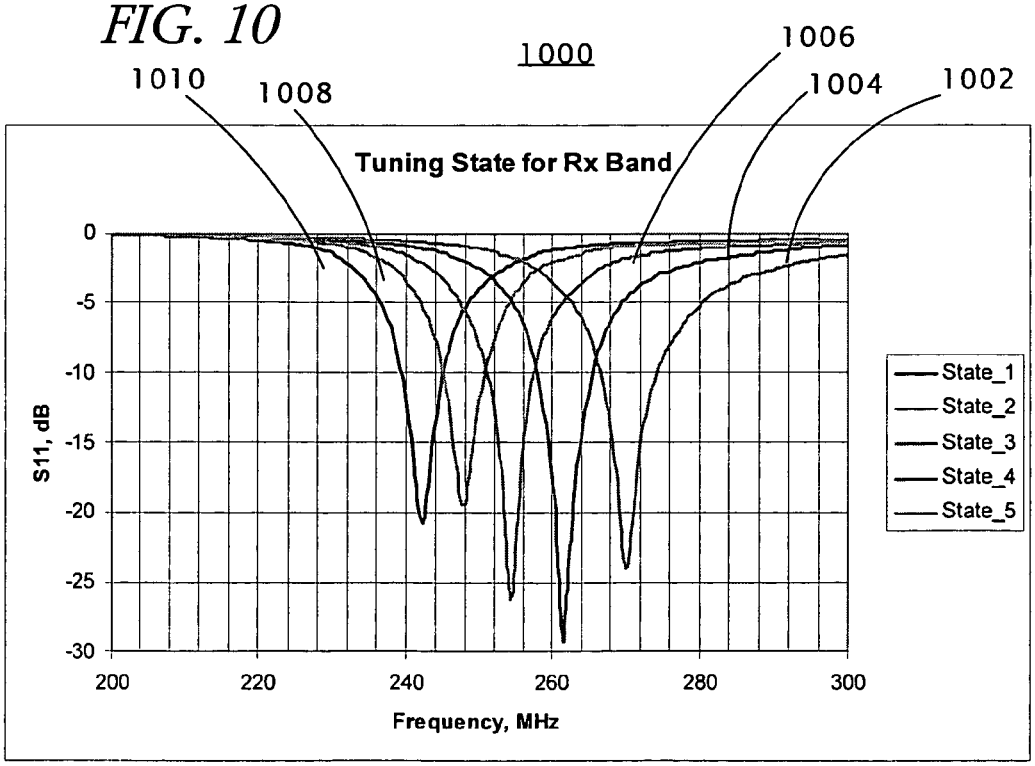
FIG. 10 is a third graph including S-parameter plots for the prototype of the antenna of the type shown in FIG. 1 in five tuning states.

FIG. 10 is a third graph 1000 including S-parameter plots 1002, 1004, 1006, 1008, 1010 for the prototype of the antenna of the type shown in FIG. 1 in five tuning states. A first plot 1002 shows the return loss with no loading on the antenna element e.g., 104, 110, and the sequence of plots 1004-1010 show the return loss with increasing capacitive loading of the antenna element, e.g., 104, 110. FIG. 9 illustrates one form of switched capacitance network that can alter the capacitive loading on the antenna element, e.g., 104, 110 in steps in order to shift the return loss plot in steps. By incrementally increasing the capacitive loading on at least one of the antenna elements 104, 110 the operating band of the antenna can be shifted so that the antenna 100 is able to support operation over a relatively broad frequency band.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims. The inventionis defined solely by the appended claims including any amendments made during the pendency of this application and all equivalents of those claims as issued.

We claim:

1. An antenna comprising:

a patterned ground plane;

a first antenna element disposed in spaced relation to said patterned ground plane;

a feed terminal coupled to said first antenna element;

wherein said patterned ground plane comprises a reentrant perimeter that extends inward underneath at least a portion of said first antenna element, whereby said at least a portion of said first antenna element does not overlie said ground plane;

said first antenna element further comprising a slot, wherein a current pattern established by feeding said first antenna element via said feed terminal includes a current flow that flows, at least partly, around said slot.

2. The antenna according to claim 1 wherein the antenna comprises a polygon shaped antenna, and said first antenna element comprises a conductor comprising a first segment and a second segment that are joined at an angle forming a corner, wherein said corner is disposed at a first vertex of said polygon shaped antenna.

3. The antenna according to claim 2 wherein said slot comprises a first portion and a second portion that are joined at an angle.

4. The antenna system according to claim 2 wherein said feed terminal is coupled to said first segment proximate said corner.

5. The antenna system according to claim 4 further comprising a ground terminal that is coupled to said second segment and said patterned ground plane proximate said corner.

6. The polygon shaped antenna according to claim 2 wherein said polygon shaped antenna comprises a quadrilateral shaped antenna.

7. The quadrilateral shaped antenna according to claim 6 further comprising:

a second antenna element disposed in spaced relation to said ground plane at a second vertex that is opposite said first vertex.

8. The antenna system according to claim 1 further comprising:

a network comprising a switch and a reactive load;

wherein said network is coupled between said first antenna element and said patterned ground plane.

9. The antenna system according to claim 8 wherein said reactive load comprises a capacitive load.

10. The antenna system according to claim 8 wherein said network is coupled to said first antenna element at a position selected such that said current flow that flows, at least partly, around said slot is coupled through said network when said switched is closed.

11. The antenna system according to claim 1 further comprising:

a dielectric substrate supporting said patterned ground plane; and a dielectric spacer supporting said first antenna element in spaced relation to said ground plane.

12. An antenna comprising:

a ground plane;

a first antenna element disposed in spaced relation to said ground plane, said first antenna element comprising a slot;

a feed terminal coupled to said antenna element;

wherein a current pattern established by feeding said first antenna element via said feed terminal includes a current flow that flows, at least partly around said slot;

a network comprising a switch and a reactive load;

wherein said ground plane comprises a reentrant perimeter that extends inward underneath at least a portion of said first antenna element, whereby said at least portion of said first antenna element does not overlie said ground plane;

wherein said network is coupled between said first antenna element and said ground plane and wherein said network is coupled to said first antenna element at a position selected such that said current that flows, at least partly, around said slot is coupled through said network when said switched is closed.

13. The antenna according to claim 12 wherein said antenna is polygon shaped, and wherein:

said first antenna element comprises a conductor comprising a first segment and a second segment that are joined at an angle forming a corner, wherein said corner is disposed at a first vertex of said polygon shaped antenna.

14. The antenna system according to claim 13 wherein said feed terminal is coupled to said first segment proximate said corner.

15. The antenna system according to claim 14 further comprising a ground terminal that is coupled to said second segment and said patterned ground plane proximate said corner.

16. The polygon shaped antenna according to claim 13 wherein said polygon shaped antenna comprises a quadrilateral shaped antenna.

17. The quadrilateral shaped antenna according to claim 13 further comprising:

a second antenna element disposed in spaced relation to said ground plane at a second vertex that is not adjacent to said first vertex.

18. The antenna system according to claim 12 further comprising a dielectric substrate supporting said ground plane and a dielectric spacer supporting said first antenna element in spaced relation to said ground plane.

* * * * *